US005697099A

United States Patent [19]

Siska, Jr. et al.

[11] Patent Number: 5,697,099

[45] Date of Patent: Dec. 16, 1997

[54] HELMET WITH AN ALARM

[76] Inventors: William D. Siska, Jr., 141 Valleyview Dr., Elma, N.Y. 14059; Timothy J. Sopko, 12199 Creek Rd., Chaffee, N.Y. 14030; Vernon C. Lenz, 306 N. 28th Ave., Yakima, Wash. 98902

[21] Appl. No.: 671,839

[22] Filed: Jun. 28, 1996

[51] Int. Cl.[6] ..... A42B 3/04

[52] U.S. Cl. ..... 2/5; 2/422; 2/906

[58] Field of Search ..... 2/5, 422, 9, 425, 2/410, 411, 906; 362/105; 340/539, 573

[56] References Cited

U.S. PATENT DOCUMENTS

| | | | |
|---|---|---|---|
| 3,201,771 | 8/1965 | Proux | 340/227 |
| 4,468,656 | 8/1984 | Clifford et al. | 340/539 |
| 4,688,025 | 8/1987 | Frank | 340/571 |
| 4,945,458 | 7/1990 | Batts et al. | 362/106 |
| 4,959,637 | 9/1990 | Woods et al. | 340/573 |
| 5,200,736 | 4/1993 | Coombs et al. | 340/586 |
| 5,329,637 | 7/1994 | Walker | 2/5 |
| 5,492,110 | 2/1996 | Lenz et al. | 128/202.22 |
| 5,564,128 | 10/1996 | Richardson | 2/422 |

*Primary Examiner*—Michael A. Neas
*Attorney, Agent, or Firm*—James J. Ralabate

[57] ABSTRACT

A helmet is supplied with a personal alarm safety system (PASS) that detects the absence of motion by the wearer. This usually indicates that the user is unconscious or otherwise incapacitated. Also in the helmet is an automatic activation means which turns on the PASS system as soon as the wearer puts on the helmet. Other features such as visual alarm and inactivation means are included in the preferred embodiment.

5 Claims, 2 Drawing Sheets

HELMET WITH AN ALARM

This invention relates to a novel helmet containing an alarm system and, more specifically, to a helmet that can be worn by firefighters, that contains a reliable alarm unit.

BACKGROUND OF THE INVENTION

When firefighters enter burning structures they generally utilize what is known as a personal alarm safety system hereinafter referred to as PASS. These PASS systems are stand alone or have been integrated with self-contained breathing apparatus (or SCBA). The stand alone PASS systems are about the size of a transistor radio and usually contain two piezo speakers to generate sound: one of a variety of motion sensors, circuitry to operate the system and typically a nine volt battery for power. The PASS systems sense a prolonged lack of motion by a firefighter, generally indicating a problem with him or her, most often indicating the wearer is unconscious or otherwise incapacitated.

There have been several problems associated with the use of these PASS systems. The most common problem is that firefighters do not turn on the system or forget to turn it on because of the excitement and sometimes disorientation of entering a burning structure and also because they can false alarm due to location of wearing. Another problem is that when the PASS systems are integrated in SCBA, removal by the firefighter of his SCBA renders the PASS system useless as an effective alarm system. Obviously, once not worn the PASS system will indicate a lack of motion and incorrectly convey that the user is motionless or unconscious. Most firefighters wear an "air pack" which when turned on will activate the PASS and when turned off will deactivate the integrated PASS when the SCBA is depressurized. Thus, if a firefighter is no longer in need of his "air pack" he can remove it and thus remove his PASS system. Also during fire clean ups, many firefighters do not wear SCBAs but are still at risk of injury and should be equipped with some type of alarm system.

Therefore, an improved method and structure is needed for firefighters that will be effective even if the user forgets to turn it on or for some reason cannot turn it on. Also, an improved method and structure is needed that will function as an alarm even when the firefighter discards his SCBA or air packs.

Since a firefighter's helmet is the one piece of equipment that stays with him or her at all times, it makes sense to incorporate a near foolproof and novel alarm system in the helmet rather than in other parts of the equipment worn. There has heretofore been fire fighters equipment used or disclosed that activates an alarm when worn such as the extensive equipment disclosed in U.S. Pat. No. 5,492,110. The heavy equipment of U.S. Pat. No. 5,492,110 (SCBAs) weighs up to 35 pounds and is discarded often by firefighters, thus preventing adequate alarm protection. This prior art patent is further discussed below in Summary of the Invention. U.S Pat. No. 4,885,796 discloses a voice-actuated switch located in a face mask for communication by the wearer.

Also, there have been many helmets that have been used which are equipped with various signaling devices such as U.S. Pat. Nos. 3,201,771; 3,845,389; 4,521,831; 4,945,458; 5,200,736 and 5,329,637.

In Proulx U.S. Pat. No. 3,201,771, a device is described which can be attached to a firefighter's helmet that detects and alarms for high heat environments. This device contains no "electronic" circuitry. It appears to be a series of thermally activated switches connected to a power source (battery). Like the present system, this system has an audible alarm but in the case of Proulx, the alarm is intended to warn the wearer of dangerous high heat environments. The present device does not detect or warn for high heat situations but rather detects non-motion by the wearer.

U.S. Pat. No. 3,845,389 (Phillips), describes the integration of a two-way radio into a firefighter's helmet. It is intended for voice communication between the wearer and others. Here, the electronics are mounted inside the helmet above the wearer's head. The present device does not receive or emit RF Signals intended for communication purposes.

Thayer, U.S. Pat. No. 4,521,831 describes the attachment of "Flash Lights" to a helmet. The present device is not intended to provide any type of "illuminating light". In addition, the present device does not intend to have the attachment and adjustability means provided by the invention described in this patent.

U.S. Pat. No. 4,945,458 (Batts) describes the integration of a system of "front and rear" lights into a firefighter's helmet. This device uses incandescent light bulbs which flash to warn others as well as help in locating the wearer. The present device uses an audio alarm to guide rescuers to a wearer-in-trouble. In addition, the present device will utilize Light Emitting Diodes which use considerably less energy than the incandescent types. Although the LEDs on the present unit can be used to aid in visually locating a wearer-in-trouble, they are advertised as devices intended to indicate that the unit is powered up and running. The present device has no externally readable clock. Instead it uses a microprocessor which will handle all circuit timing functions. The present invention timing functions do not include the ability to memorize the duration of time that a wearer is in a particular hazardous situation as is the case with the clock described in the Batts patent. In the present invention, there are no means of activating the device remotely since the device in one mode is activated automatically by lack of motion of the wearer.

Coombs, U.S. Pat. No. 5,200,736, describes a device which will alert the wearer of an increasing (elevating) environmental temperature situation indicated by a series of LEDs of different colors. Also, Coombs warns the wearer audibly when a predetermined temperature threshhold has been reached. Again, the present device does not detect or react to thermal conditions.

Walker, U.S. Pat. No. 5,329,637 is similar to the structure of U.S. Pat. No. 4,945,458 above discussed. None of the above-discussed helmet structures discloses a motion-detecting alarm (or lack of motion) that is automatically activated upon the wearer putting on the helmet.

SUMMARY OF THE INVENTION

It is therefore an object of this invention to provide a helmet devoid of the above-noted disadvantages.

Another object of this invention is to provide a helmet to be used by firefighters and others that is automatically activated upon the user wearing it.

Still a further object of this invention is to provide an effective optimum alarm that will signal a lack of motion by the wearer.

Another still further object of this invention is to provide an alarm-helmet that is not easily deactivated or turned off by the user or others intentionally or inadvertently.

Yet a further object of this invention is to provide a lack of motion-detecting device that can be originally manufactured into a helmet or can be easily retrofitted into existing helmets.

Still yet another object of this invention is to provide a motion-detecting device in the one piece of equipment most often not taken off by a firefighter.

Yet still a further object of this invention is to provide an automatically activated helmet alarm that also contains flashing lights or means for visual locating.

These and other objects of this invention will become apparent upon a reading of this disclosure and are provided generally speaking by a helmet having an internally-located, automatically wear-activated alarm that has a lack of motion detecting capability and which contains sound and visual alarm means. This alarm unit can be provided as original equipment manufactured integral with the helmet or can be a unit easily retrofitted onto or in existing helmets. The helmet alarm is only deactivated by removing the helmet and depressing the reset button more than once within a preset time interval. While this automatic alarm system will be described herein for use by firefighters, it should be understood that it can be used in any helmet such as those worn by construction workers, miners, forest rangers, the military and the like. The type of motion or lack of motion alarm used in this invention is the type described in U.S. Pat. No. 4,688,025. While the "must" items or components of the helmet of the present invention include a motion/lack of motion detector alarm (PASS) and an automatic PASS activation means, other components may be used if desired. For example, in a preferred embodiment the helmet of this invention contains the following features:

(A) Automatic operation initiation by placing helmet on the head: other suitable immediate activation means may be used;

(B) Pre-alert alarm resetability by depressing reset button or effecting motion;

(C) Panic button which allows the user to force the device into full alarm mode;

(D) System shut down by removing the helmet and depressing the reset button more than once within a fixed period of time;

(E) Standard battery(s) or power source;

(F) Flashing lights or LED's for visual locating assistance.

The alarm of this invention as noted above can be retrofitted into existing helmets or can be original equipment manufactured into the helmet. Each will be described later in reference to the drawings. The critical features of the invention include:

(1) means to activate the alarm or turn it on immediately upon placing it upon the user's head;

(2) a lack of motion detection alarm or means; and (3) a flashing or other external helmet means for visually locating the fallen firefighter or other user. The following are important advantages of the present invention over the prior art:

(A) The integrated helmet PASS of this invention will be initialized (turned on) automatically as a result of the user (wearer) donning the helmet. Specifically, when the user wears the firefighting helmet with integrated helmet PASS on his or her head and adjusts the helmet suspension and chin strap per helmet manufacturer's instructions, the helmet integrated PASS will automatically turn on.

All known stand alone PASS systems require deliberate user action to initialize, i.e. the user is required to consciously turn the unit on. The user can forget to turn it on or can intentionally not turn it on. Many stand alone PASSES go into false alarm which annoys wearers to the point where they turn the PASS off or never bother to turn it on.

(B) The helmet PASS of the present invention cannot easily be turned off by the wearer, i.e. to deactivate (turn off) the initialized helmet PASS, the user will be required to remove the helmet from his or her head and depress a reset button at least two consecutive times within two seconds. This ensures that if the helmet is knocked off the wearer's head, the PASS will remain operational and continue to sense lack of motion and alarm as a result.

All known stand alone PASS systems are easily turned off, i.e. the user turns stand alone PASS on so their superior is satisfied but once inside the burning structure and out of the supervisor's sight, they sometimes turn it off due to frequent false alarming.

(C) The integrated helmet PASS of this invention is intrinsically located on the portion of the human anatomy which is, regardless of all typical physical circumstances, moving or in some sort of motion most often (highest frequency). Also, regardless of most physical work-related circumstances (firefighting in particular), the helmet PASS of this invention is intrinsically located on the part of the human anatomy which is most easily consciously "moved" in such a way that the lack of motion sensor in the PASS system can sense the motion.

All known stand alone as well as SCBA integrated PASS systems (MSA, Scott, etc.) have their respective lack of motion sensors located on the immediate torso region of the wearer, i.e. waist belt, shoulder harness, chest, etc. While the user is engaged in physical labor, holding a fire hose, carrying a downed person, etc. it is very difficult to consciously move the torso region of the body in a manner sufficient to prevent the PASS from going into full alarm. This is one of the most significant causes of firefighters turning off their PASS systems because the PASS systems continually false alarm.

(D) The integrated helmet PASS of this invention is intrinsically located in or on a piece of equipment (helmet) that all types of firefighters (structure, industrial, oil field, forest, etc.) wear as a minimum under all circumstances all the time.

Not all firefighters wear or use their SCBAs all of the time, i.e. firefighters fighting forest fires rarely wear SCBAs. Also, during mop up of structure fires, firefighters rarely wear SCBAs. However, during all of these circumstances, helmets are most always worn.

(E) The chances of rescuers attempting to save a downed (injured) PASS wearer only to find a PASS or SCBA but no wearer are significantly minimized with the present integrated helmet PASS design. All helmet manufacturers require fastening and proper adjustment of chin straps which prevent the helmet from falling or being knocked off the wearer's head. In the unlikely event that the helmet is knocked off the wearer's head when he or she is downed, the helmet (with integrated PASS) will typically remain within approximately a ten foot radius of the downed wearer. Therefore, when rescuers locate the alarming helmet, the downed wearer can be readily located and saved.

There are circumstances when the wearer of a SCBA will remove his or her SCBA either to facilitate escape from a dangerous environment via a tight escape route or because the SCBA runs out of air. In both cases, if the abandoned SCBA in question has an integrated SCBA PASS, the PASS will ultimately alarm. Ignorant rescuers will then attempt to locate and save what they believe is a downed firefighter only to find an abandoned SCBA. This needlessly endangers rescuers. It should be noted, the escaping wearer of the SCBA integrated PASS could disable the integrated PASS by depressurizing the SCBA, venting and deactivating. However, under duress, there is typically not enough time.

The alarm turn on switch used in the helmet can be any suitable means. One means to activate would be a pressure-sensing head detector. This approach would require installation into the helmet of one or more (preferrably one) pressure-sensing head detector. The head detector will be a self-contained, water resistant, small, lightweight assembly which will easily attach to the headband of the helmet. An effort to make the design of the assembly "generic", i.e. compatible with all major helmet brand headbands, will be made but discrete assemblies for respective helmet headbands may be required. The preferred location locally on the helmet headband will be in the region of the "back" of the wearer's head. This minimizes the length of the wire harness which connects the detector assembly to the main PASS assembly thereby minimizing the chances of wire harness being "snagged" or damaged. Head detector assembly will require minimal force to be activated which will represent an undetectable contact with the helmet wearer's head by the wearer. The assembly will embody a simple micro or tact switch (momentary). The switch will be activated via a simple lever arm which will serve to amplify force detected as a result of contact with the wearer's head to switch.

The helmet integrated PASS of the present invention represents a significant improvement over the SCBA integrated pass with switch or switches which automatically activate the SCBA integrated PASS when the wearer puts the SCBA on referred to in the above noted U.S. Pat. No. 5,492,110 for the following reasons:

(1) The SCBA is only donned (put on) by firefighters or hazardous environment workers under specific circumstances. Users typically only don the SCBA when they expect to enter a situation where the atmosphere may be hazardous or I.D.L.H. (Immediately Dangerous to Life or Health). Donning the SCBA at this point means wearing the SCBA by utilizing the harness system with waist belt and shoulder harnesses properly adjusted and fastened. Typically the air tank valve is opened so as to pressurize the system readying it to supply fresh breathing air to the user but with the mask off the user's face and hanging at the user's side. Most mask mounted regulators also typically incorporate a manual shut off mechanism with first breath activation. That is, when the regulator's manual shut off is activated, the regulator does not supply air, however when the user dons the mask and takes a breath (inhales), the regulator responds by turning on the supplying air. This popular mechanism allows the user to don the SCBA completely except for the mask. As a result, the switch located in the mask in rendered ineffective. Users only wear an SCBA when absolutely necessary for the following reasons: (A) SCBAs typically weigh up to 35 pounds. This additional weight slows the wearer down and tires them more quickly. Also the wearer often discards this equipment, thus not utilizing any alarm system: (B) SCBAs represent a significant bulk and size disadvantage even when properly adjusted and worn which can hamper the wearer's movement.

In contrast, the helmet of this invention is typically always worn regardless of all circumstances. The first thing all user's typically do when responding to a call is don their helmet.

(2) While user's only don an SCBA under particular circumstances as noted above, they only actually put the mask on their face thereby utilizing the SCBA air supply when absolutely necessary for the following reasons:

(A) with the SCBA mask properly donned, face-to-face and non-face-to-face (via radio) communications are significantly compromised: (B) the SCBA air supply is finite and may be critical to ensure the wearer can safely exit a hazardous atmosphere, therefore air is typically conserved. This requires the mask not be donned.

In contrast again, the helmet of this invention is typically always worn under these same circumstances ensuring the helmet PASS is always automatically activated.

(3) Helmets are always personal-issue equipment for all fire companies which guarantees all users have their own helmet. Therefore, all users would be readily equipped with a PASS system with the helmet PASS of this invention. In contrast, SCBAs are typically not personal-issue. Furthermore, because SCBAs cost as much as $5,000 each, one SCBA is often shared by many users, thereby not providing each firefighter with an alarm system.

(4) The automatic activation function of the device described in the above noted U.S. Pat. No. 5,492,110 is effected by activation of at least one or two of the multiple switches located on the SCBA. Multiple switches are provided to ensure the SCBA integrated PASS is automatically activated for all wearers every time. This multitude of automatic turn-on switches creates a major problem in practical application with accidental activation of the PASS system. SCBAs, regardless of where they are stored (lockers, jump seats, carriers, etc.), are typically either hung, rested on a surface or placed in an enclosure such as a carrying case or truck compartment. Consequently, two of the automatic turn on switches located on the SCBA can be readily activated therby giving false signal to the integrated PASS that a user has donned the SCBA causing the PASS to turn on. Since there is no one wearing the SCBA and no associated motion, the PASS detects lack of motion and alarms. This is not only an annoyance but causes the PASS battery to be prematurely exhausted. In contrast, the automatic activation means for the helmet PASS of this invention is located on the interior of the helmet so as to maximize the chance of turning on every time the helmet is worn by a user. However, at the same time, this interior location of the automatic turn on mechanism of the helmet PASS minimizes the chance of false activation due to the fact that it is concealed from inadvertent mechanical contact when not being worn.

The primary components of this invention and associated functions are:

(1) Head Detector Switch Assembly—This assembly will readily attach to various helmet head harness systems (no special tools or helmet modifications required).

Once installed, a flexible, spring-loaded arm will be positioned such that when the helmet is donned (put on the head) the arm will be significantly deflected. This arm deflection will be communicated mechanically to a switch (momentary tack switch) located within the head detector switch assembly housing. The activation of the head detector switch will be communicated electronically to the main helmet PASS assembly via cable. Force required to deflect the arm of the head detector assembly will be negligable, i.e. the wearer of the helmet will not feel force. The head detector assembly will in no way affect function of the helmet or helmet harness, head detector assembly cable will "plug" into the bottom half of the main helmet PASS and is therfore replaceable.

(2) Main Helmet PASS Assembly—The main helmet PASS assembly will comprise two primary parts, the top half and bottom half. To install the main PASS assembly on a helmet, two holes will be required to be drilled in the rear brim of the helmet. The top and bottom halves of the main assembly will fasten to each other via drilled holes in helmets thereby "sandwiching" the helmet brim. The top half will house the piezo speakers which will generate the audible alarm required of PASS systems and status indicating LEDs. The bottom half could house 9 V alkaline battery, microprocessor and all related electronics, lack of motion sensor, emergency switch, reset switch and jack to receive plug of cable for head detector switch assembly.

In the prior art, putting lack of motion detector on one's body or chest permits a good likelihood of a false alarm. This is because the person, even if unconscious, is still breathing and this motion of the chest rising and falling would not set off the lack of motion detector and give a false signal of movement. In contrast, in the present invention, because the head is constantly moving and will not move upon incapacitation of the wearer, a true and optimum alert of lack of motion is accomplished with the sensor and alarm in the helmet.

DETAILED DESCRIPTION OF THE DRAWING AND PREFERRED EMBODIMENTS

Figure 1:
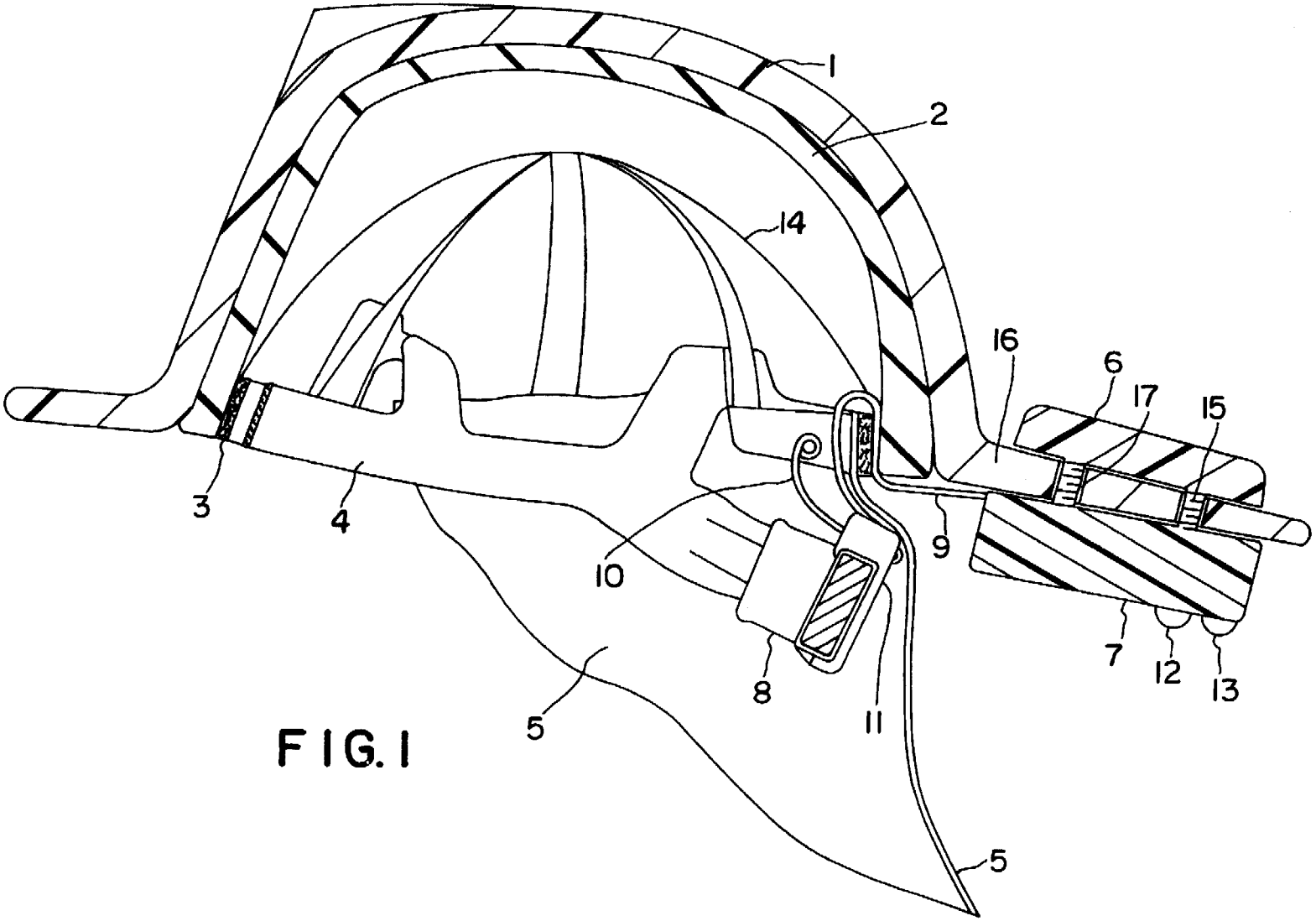
FIG. 1 is a breakaway plan view of a helmet with the components of this invention illustrated in situ.

The helmet outer shell 1 in FIG. 1 is a conventional shell made from hard plastics such as polycarbonates, polyurethanes, polyvinyls, polyamides or other suitable material. The helmet inner shell 2 generally comprises a resilient shock-absorbing material that will protect the wearer to the extent possible from the impact of falling debris and the like. The inner harness 3 has a VELCRO® (Trademark of Velcro USA, Inc., 406 Brown Ave., Manchester, N.H.) carrier for the user's forehead pad with an appropriate neck shield attachment 5. Around the lower portion of the helmet 1 is a head harness 4 which fits around the circumference of the wearer's head. Generally, harness 4 has harness suspension straps 14 which provide coverage for the top of the user's head. The neck shield 5 is made from any suitable material that generally is flameproof and given optimum protection for the neck of the user. The PASS unit has top half assembly 6 which is attached to the bottom half 7 of PASS unit by bolts or other attachment means 15 which fit through apertures 17 in helmet back peak 16. The bottom half or lack of motion detector 7 of PASS contains the main alarm means such as that disclosed in U.S. Pat. No. 4,688,025. In the bottom half 7 are located helmet PASS reset button 12 and PASS emergency button 13. The reset button 12 as above noted can only turn off the alarm means 7 by being pressed two or more times in a fixed period of time usually about two to three seconds. The emergency button 13 is available to the user to alert others to his or her problem. The head detector switch assembly 11 is automatically turned on or activated by the user's head contacting the flexible probe 10. The head detector switch assembly 11 is connected to the lack of motion detector 7 by an electrical connecting cable or wire means 9. Any suitable mechanical or electrical or other connecting means may be used if desired. Once the detector 7 is activated, it cannot easily be deactivated to protect against inadvertant deactivation. To deactivate the lack of motion detector 7 the helmet must be first removed from the wearer's head and the button 12 must be pressed two or more times in a short period of time. A head harness adjuster 8 is used for proper fit on the wearer's head.

Figure 2:
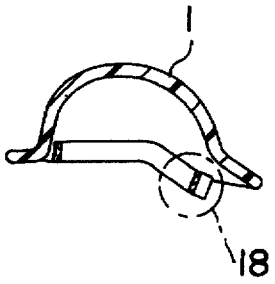
FIG. 2 is a helmet outline circled to show the location of the expanded view of FIG. 3.
Figure 3:
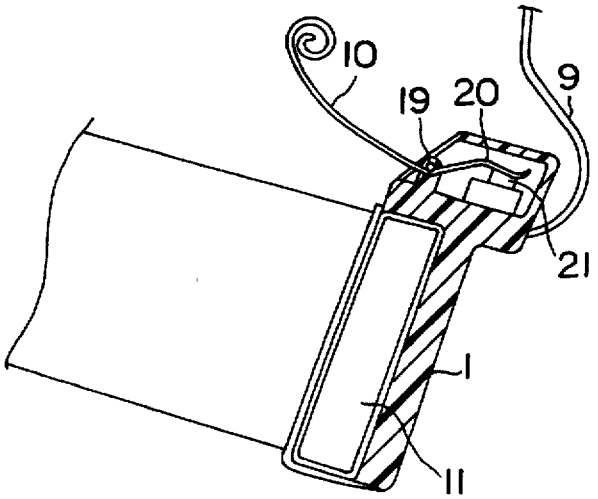
FIG. 3 is an expanded view illustrating the automatic turn on or activation means together with the location of the lack of motion detector.

In FIG. 2 and in FIG. 3 specifics of the head detector switch assembly 11 are shown. FIG. 2 shows by a circle 18 the location of the components of the system of this invention. In FIG. 3 the head detector switch assembly 11 is shown together with the flexible probe 10 which activates the total alarm unit. Once the head of the user contacts probe 10, lever focal means 19 allows probe set section 20 to hit activation button 21 to turn on the alarm PASS system. The electrical cable or wire 9 is connected to the switch assembly 11 and activates the PASS system upon head contact with probe 10. The helmet as noted has an outer shell 1 made from a thermoplastic high impact, flame retardant material. Once the PASS is activated, it will stay active until the helmet is removed from the wearer's head and the reset button 12 (shown in FIG. 1) is twice pressed. This ensures against accidental inactivation of the PASS unit. The battery or power source can be located in detector 7 as shown in FIG. 1.

Figure 4:
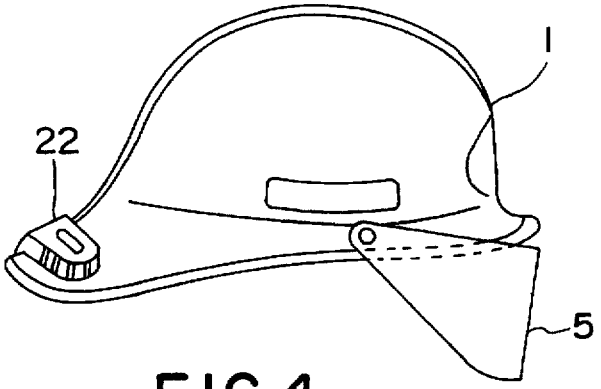
FIG. 4 is an embodiment showing a retrofit unit of this invention installed on an existing helmet.

In FIG. 4 the exterior of a helmet 1 is illustrated as it is retrofitted with an external PASS system 22. The external PASS system 22 has a visual signal means or light (or LED) 23 which flashes and assists searchers to locate the fallen or incapacitated firefighter.

Figure 5:
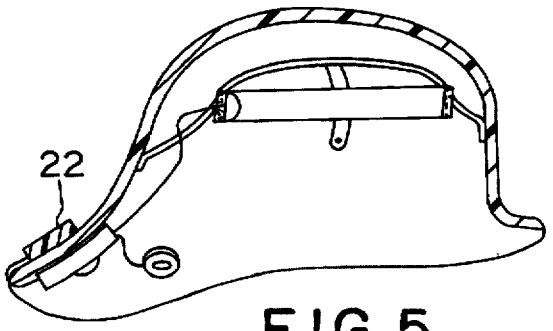
FIG. 5 is a breakaway view of the retrofit unit and helmet of FIG. 4.

FIG. 5 shows a cutaway view of the retrofitted helmet of FIG. 4. The helmet PASS of FIG. 5 would function as described in reference to FIG. 1 above. The retrofitted PASS system 22 can be installed on any suitable portion of the helmet and in any suitable mounting fashion.

The preferred and optimumly preferred embodiments of the present invention have been described herein and shown in the accompanying drawings to illustrate the underlying principles of the invention but it is to be understood that numerous modifications and ramifications may be made without departing from the spirit and scope of this invention.

What is claimed is:

1. A safety helmet having integral therewith activation means, a source of power, and a personal alarm safety system commonly known as "PASS", said PASS system having means to detect the absence of motion of a wearer, said PASS system integral with said helmet, said activation means having means in cooperation therewith to turn on said PASS system, said activation means comprising means inside said helmet which when contacted by said wearer's head will immediately and automatically activate said PASS system, said PASS system also comprising inactivation means to manually inactivate said PASS system when said safety helmet is off the wearer's head and not in use, said inactivation means comprises an inactivation button in contact with said PASS system, said inactivation button having inactivation means whereby the wearer must depress said button at least two times during a set period of time to inactivate said system, and wherein said safety helmet has flashing visible signals to assist searchers to locate said helmet and said wearer.

2. The safety helmet of claim 1 wherein said PASS system includes reset means for restarting PASS system after inactivation.

3. The safety helmet of claim 1 wherein said helmet contains a panic button and corresponding alarm which may be manually activated by a wearer when required.

4. The safety helmet of claim 1 wherein said PASS system has a movement sensor with detection means for a first signal to warn user of impending second different audible signal and alarm when detecting lack of movement.

5. The safety helmet of claim 1 wherein said PASS system has a movement sensor with detection means for a first audible signal and cancellable alarm when initially detecting lack of movement and a second different audible signal and non-cancellable alarm when detecting continued lack of movement.

* * * * *